US009010406B2

(12) United States Patent
Wang et al.

(10) Patent No.: US 9,010,406 B2
(45) Date of Patent: Apr. 21, 2015

(54) HEAT DISSIPATION MODULE

(75) Inventors: Yu-Hsuan Wang, New Taipei (TW); Chung-Kai Hsu, New Taipei (TW); Chia-Yang Liu, New Taipei (TW)

(73) Assignee: Foxconn Technology Co., Ltd., New Taipei (TW)

( * ) Notice: Subject to any disclaimer, the term of this patent is extended or adjusted under 35 U.S.C. 154(b) by 393 days.

(21) Appl. No.: 13/433,308

(22) Filed: Mar. 29, 2012

(65) Prior Publication Data

US 2013/0168047 A1 Jul. 4, 2013

(30) Foreign Application Priority Data

Dec. 28, 2011 (TW) ..... 100149144 A

(51) Int. Cl.
*F28D 15/02* (2006.01)

(52) U.S. Cl.
CPC ..... *F28D 15/0233* (2013.01); *F28D 15/0275* (2013.01)

(58) Field of Classification Search
CPC ..... H05K 7/20145; H05K 7/20154; H05K 7/20163; F28D 15/0275
USPC ..... 165/80.3, 104.33, 122; 361/695, 697, 361/700
See application file for complete search history.

(56) References Cited

U.S. PATENT DOCUMENTS

| | | | | |
|---|---|---|---|---|
| 6,399,877 | B1 * | 6/2002 | Sakamoto | 174/16.3 |
| 6,474,409 | B1 * | 11/2002 | Sterner | 165/96 |
| 6,525,936 | B2 * | 2/2003 | Beitelmal et al. | 361/695 |
| 6,732,786 | B1 * | 5/2004 | Lee | 165/80.3 |
| 6,914,782 | B2 * | 7/2005 | Ku | 361/700 |
| 6,924,978 | B2 * | 8/2005 | DiStefano | 361/688 |
| 7,697,288 | B2 * | 4/2010 | Okutsu | 361/695 |
| 2008/0043436 | A1 * | 2/2008 | Hung et al. | 361/700 |

* cited by examiner

*Primary Examiner* — Allen Flanigan
(74) *Attorney, Agent, or Firm* — Novak Druce Connolly Bove + Quigg LLP

(57) ABSTRACT

A heat dissipation module includes a fan, a heat sink and a heat pipe. The fan defines an air outlet at one side thereof. The duct extends from the fan and away from the air outlet. The duct includes a first open end communicating with the fan and a second open end adjacent to a heat generating component. The located is located at the air outlet of the fan. The heat pipe thermally interconnects the heat sink and the heat generating component. The duct guides a part of airflow generated by the fan to the heat generating component during operation of the fan.

19 Claims, 4 Drawing Sheets

HEAT DISSIPATION MODULE

BACKGROUND

1. Technical Field

The disclosure relates to heat dissipation, and particularly to a heat dissipation module with a fan duct.

2. Description of Related Art

A heat dissipation module is often used to dissipate heat from heat generating components, such as central procession units (CPUs). Many conventional heat dissipation modules include a centrifugal fan, a fin assembly arranged at an air outlet of the fan, and a heat pipe thermally connected a heat generating component with the fin assembly.

During operation, heat generated by the heat generating component is transferred to the fin assembly via the heat pipe. The fan generates an airflow through the fin assembly to dissipate the heat. However, the heat generated by the heat generating component is taken away only by making using of the airflow towards the fin assembly, resulting in a unitary heat dissipation way. Thus, a heat dissipation efficiency of the heat dissipation module is not satisfactory.

Thus, it is desired to overcome the described limitations.

DETAILED DESCRIPTION

Figure 1:
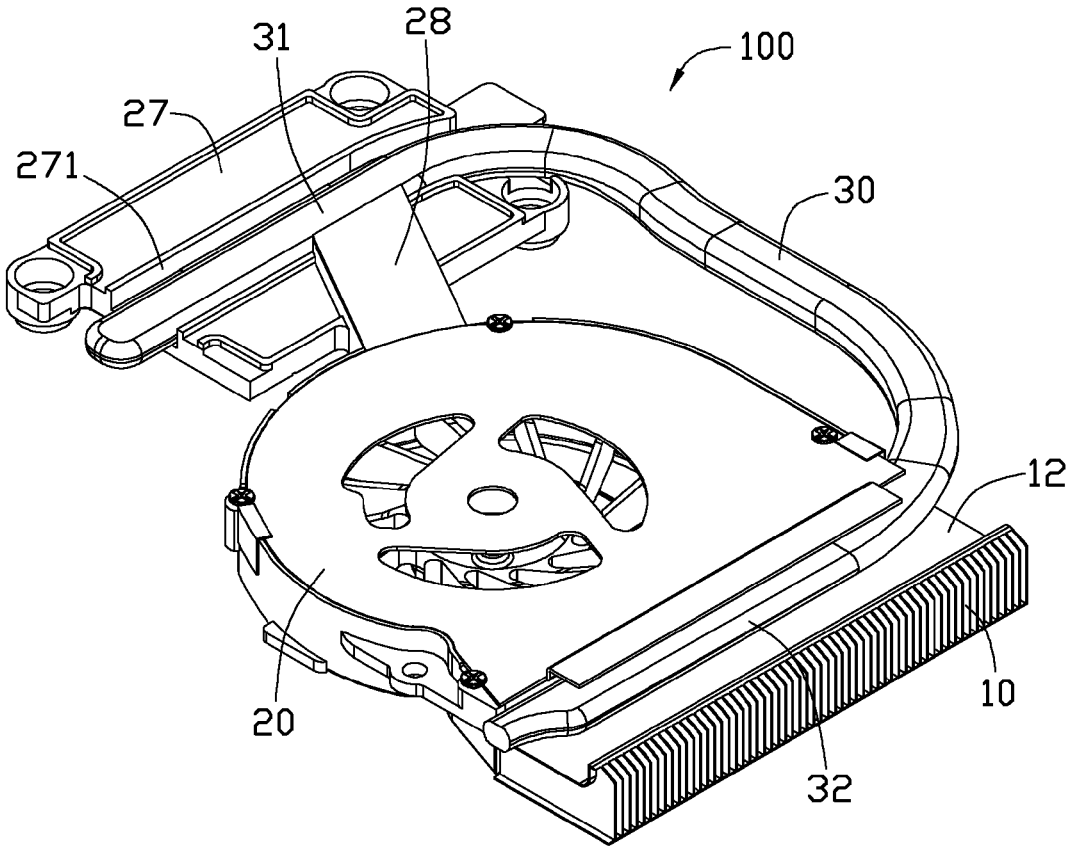
FIG. 1 is an assembled, isometric view of a heat dissipation module, according to an exemplary embodiment of the present disclosure.
Figure 2:
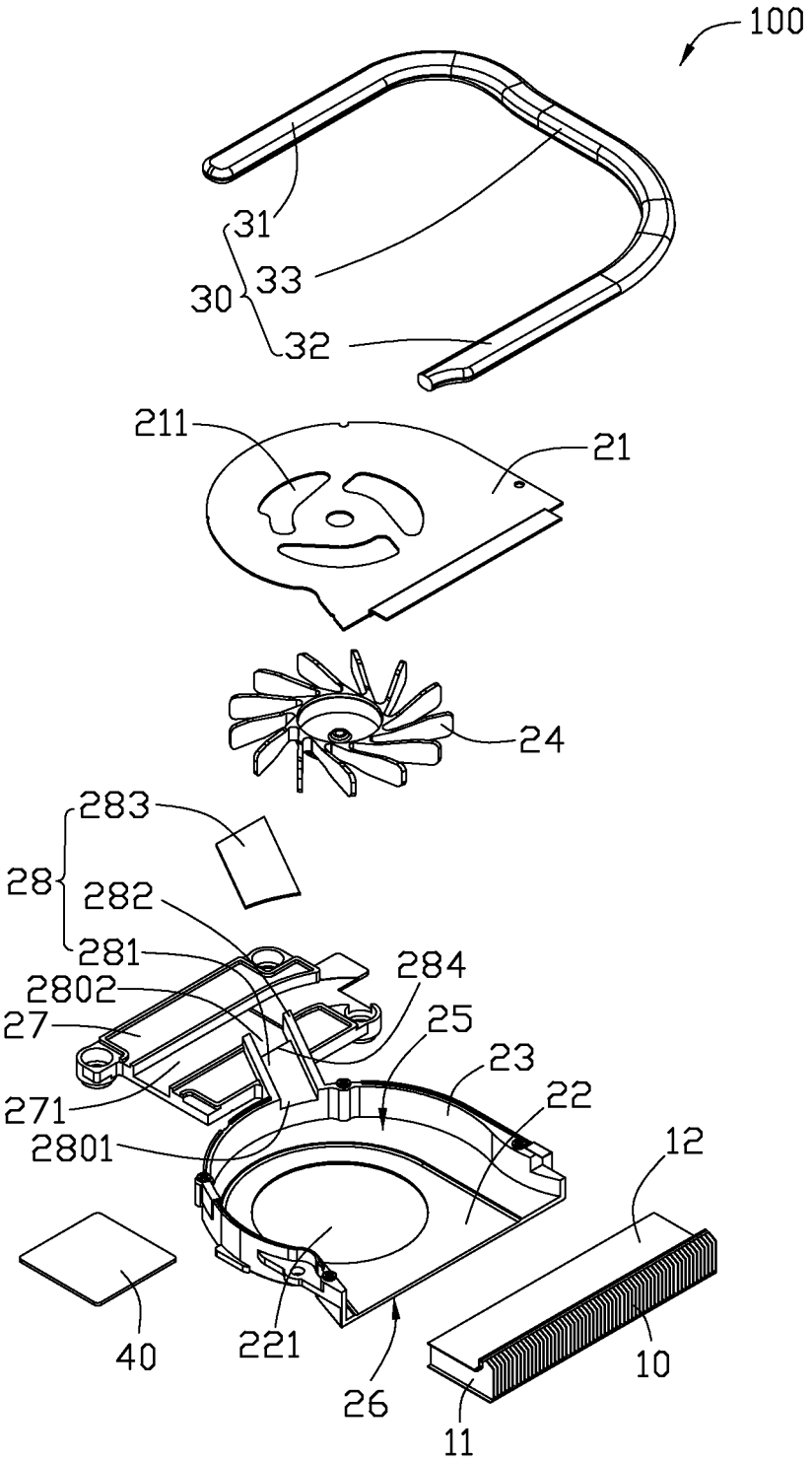
FIG. 2 is an exploded, isometric view of the heat dissipation module of FIG. 1.
Figure 3:
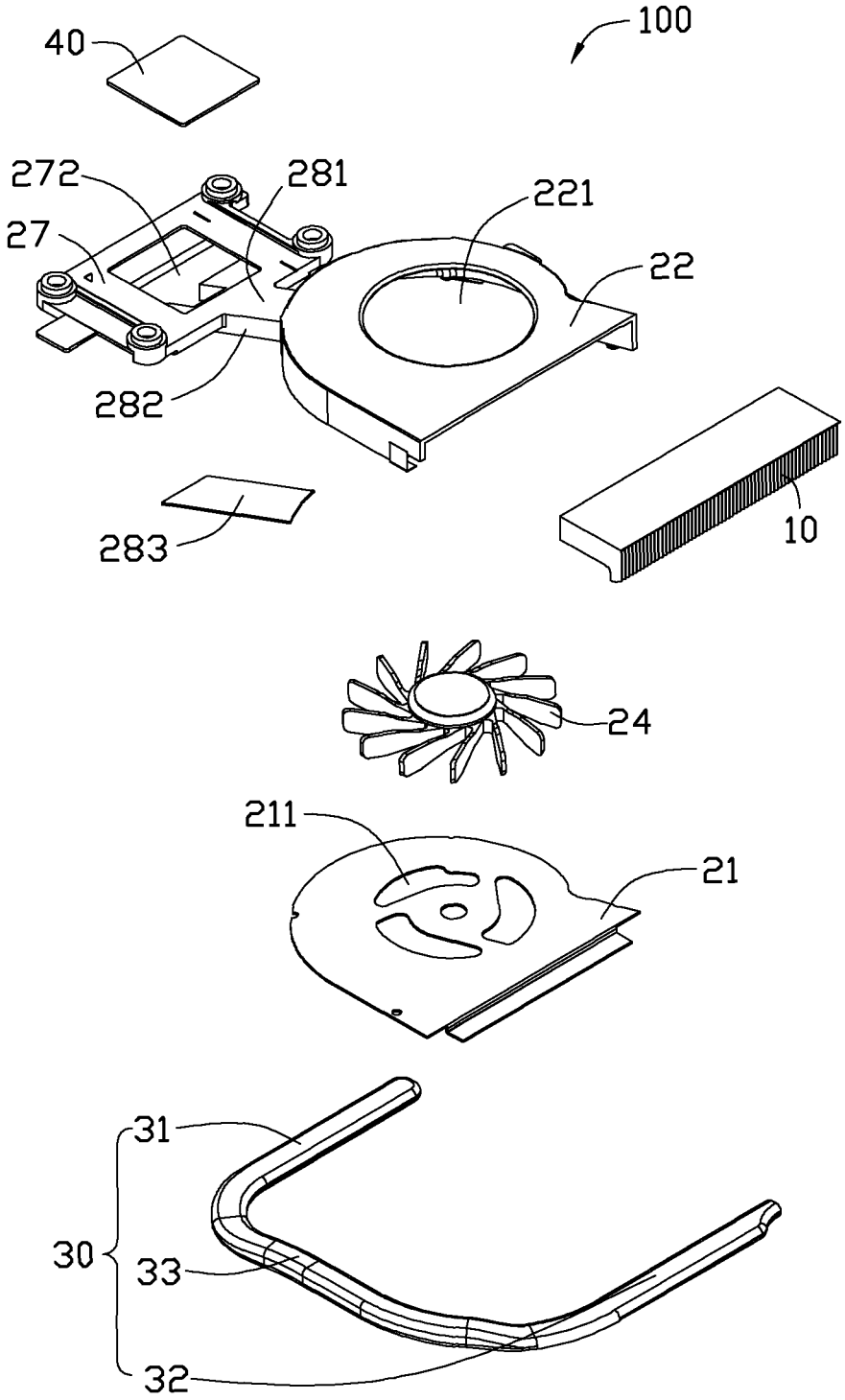
FIG. 3 is an inverted view of the heat dissipation module of FIG. 2.

FIGS. 1 to 3 show a heat dissipation module 100 in accordance with an exemplary embodiment of the present disclosure. The heat dissipation module 100 includes a heat sink 10, a fan 20, a heat absorption plate 40, and a heat pipe 30 thermally interconnecting the heat sink 10 and the heat absorption plate 40.

The fan 20 is a centrifugal fan, which includes a base 22, a sidewall 23 extending perpendicularly and upwardly from an outer periphery of the base 22, a cover 21 engaging with the sidewall 23, and an impeller 24. The cover 21, the base 22 and the sidewall 23 cooperatively define a cavity 25, the impeller 24 is received in the cavity 25. The cover 21 and the base 22 respectively define a plurality of first air inlets 211 and a second air inlet 221. The base 22 and the sidewall 23 cooperatively define an air outlet 26 between two ends of the sidewall 23.

The heat sink 10 is located at the air outlet 26 of the fan 20, and includes a plurality of fins 11 stacked together. Each fin 11 is parallel to and spaced from a neighboring fin 11. A passage (not labeled) is defined between each two neighboring fins 11 for airflow generated by the fan 20. In the present embodiment, one lateral side of the stacked fins 11 away from the fan 20 extends upwardly to define a notch 12 in a top portion of the heat sink 10 near the air outlet 26 of the fan 20.

A duct 28 extends from the sidewall 23 of the fan 20 away from the outlet 26 of the fan 20, and interconnects a fixing board 27 and the sidewall 23 of the fan 20. The duct 28 and the outlet 26 are located at two opposite sides of the fan 20, respectively. The fixing board 27 is parallel to the base 22 of the fan 20. The fixing board 27 defines an elongated channel 271 in a top surface, and a receiving hole 272 in a bottom surface for receiving the heat absorption plate 40. In the present embodiment, the receiving hole 272 communicates with the channel 271. The heat absorption plate 40 thermally connects a heat generating component (not shown) to absorb heat generated therefrom. The duct 28 is a hollow sealed channel with two open ends, and cooperatively defined by a bottom plate 281, two side plates 282 extending from two opposite sides of the bottom plate 281, and a top plate 283. The bottom plate 281 and the two side plates 282 are integral with the sidewall 23 by formed from one piece member. A first open end 2801 of the duct 28 extends to and communicates with the cavity 25 of the fan 20, and a second open end 2802 extends to and communicates with the receiving hole 272. The two side plates 282 and the top plate 283 extend beyond an edge 284 of the bottom plate 281. The heat generating component is adjacent to the second open end 2802 of the duct 28. When the heat dissipation module 100 works, a part of the airflow generated by the fan 20 is guided to the heat sink 10 via the outlet 26, and another part of airflow is guided to the heat absorption plate 40 and the heat generating component via the duct 28. In this embodiment, the first open end 2801 of the duct 28 communicates with the cavity 25 by the first open end 2801 extending into and through the sidewall 23.

The heat pipe 30 is U-shaped, and includes an evaporator section 31, a condenser section 32 parallel to and spaced from the evaporator section 31, and a connecting section 33 interconnecting the evaporator section 31 and the condenser section 32. The evaporator section 31 is received in the elongated channel 271 and thermally connects the heat absorption plate 40. The condenser section 32 is received in the notch 12 of the heat sink 10.

Figure 4:
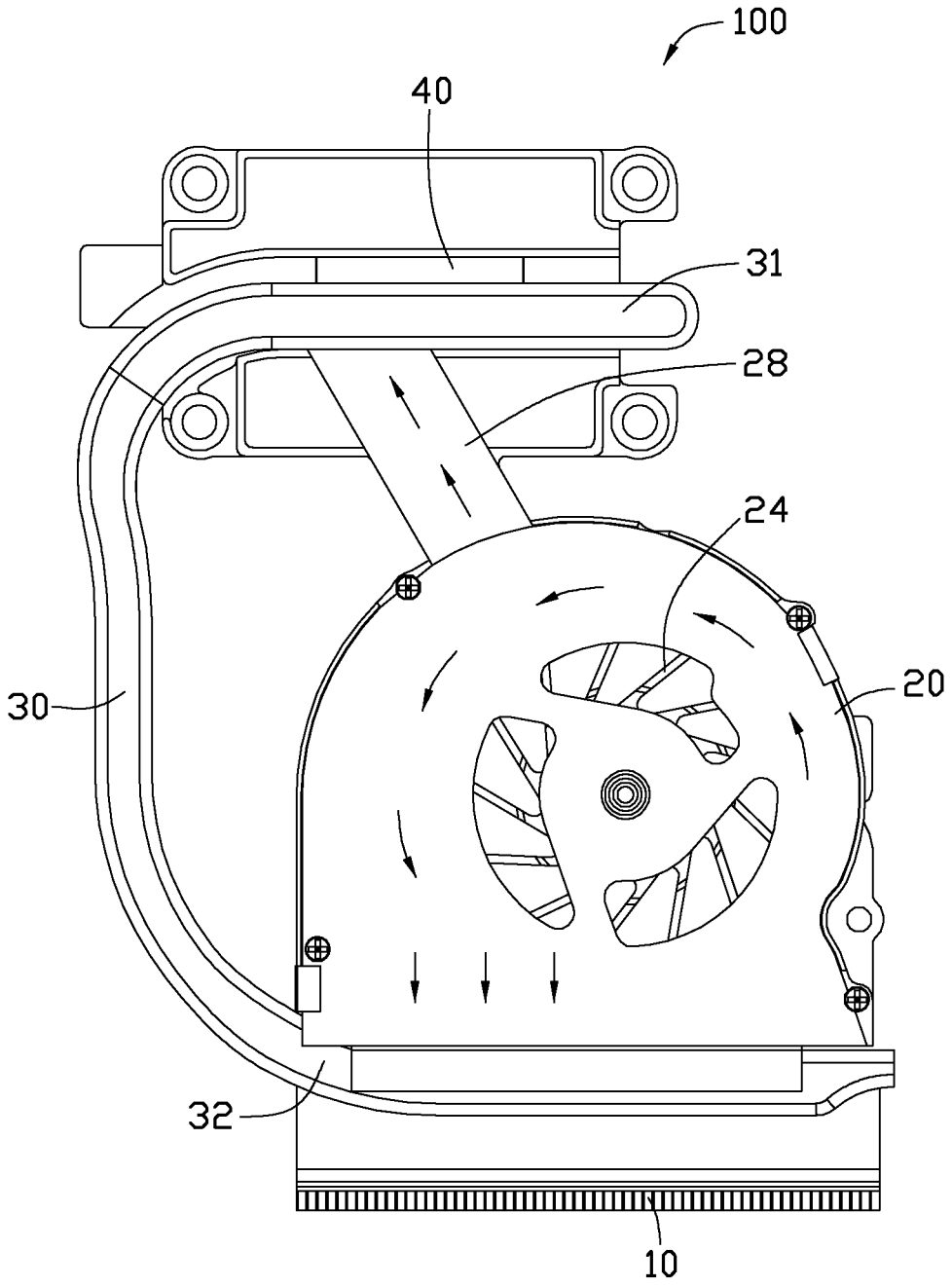
FIG. 4 is a schematic view showing a work state of the heat dissipation module of FIG. 1.

Referring to FIG. 4, during operation, heat generated by the heat generating component is evenly absorbed by the heat absorption board 40. A part of the heat from the heat absorption board 40 is absorbed by the evaporator section 31 of the heat pipe 30, and transferred to the heat sink 10 via the condenser section 32. The impeller 24 of the fan 20 rotates and drives airflow towards the air outlet 26 and the duct 28. A part of the airflow towards the air outlet 26 takes away the heat absorbed by the heat sink 10; thereby defining a first heat dissipation way. Another part of the airflow towards the duct 28 passes through the duct 28 and directly cools the heat generating component, the condenser section 32 and the heat absorption plate 40 adjacent to the duct 28; thereby defining a second heat dissipation way. The duct 28 functions as an air guiding channel to dissipate heat generated by the heat generating component, it can prevent the heat from being over concentrated in the heat generating component and the heat absorption plate 40; therefore, it can improve heat dissipation efficiency of the heat dissipation module 100.

It is to be further understood that even though numerous characteristics and advantages have been set forth in the foregoing description of embodiments, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

What is claimed is:

1. A heat dissipation module comprising:

a fan defining an air outlet at one side thereof;

a duct extending from the fan and away from the air outlet, the duct comprising a first open end communicating with the fan and a second open end adjacent to a heat generating component;

a heat sink located at the air outlet of the fan; and a heat pipe thermally interconnecting the heat sink and the heat generating component;

wherein the duct guides a part of airflow generated by the fan to the heat generating component during operation of the fan, the duct further comprises a bottom plate and two side plates extending from two opposite sides of the bottom plate, and the two side plates extend beyond an edge of the bottom plate.

2. The heat dissipation module of claim 1, wherein the fan is a centrifugal fan, the air outlet and the duct being located at two opposite sides of the fan.

3. The heat dissipation module of claim 1, wherein the duct is a hollow sealed channel with the first open end and the second open end, the first open end of the duct extending to and communicating with the fan, the second open end thereof facing the heat generating component.

4. The heat dissipation module of claim 1, further comprising a fixing board connecting a sidewall of the fan via the duct, the heat generating component thermally connecting a bottom surface of the fixing board, the heat pipe thermally connecting a top surface of the fixing board.

5. The heat dissipation module of claim 4, further comprising a heat absorption board for thermally connecting the heat generating component, wherein the fixing board defines an elongated channel in the top surface thereof receiving a first end of the heat pipe, and a receiving hole in the bottom surface receiving the heat absorption board therein.

6. The heat dissipation module of claim 5, wherein the receiving hole communicates with the elongated channel.

7. The heat dissipation module of claim 5, wherein the heat pipe comprises an evaporator section, a condenser section, and a connecting section interconnecting the evaporator section and the condenser section, the evaporator section being received in the elongated channel of the fixing board.

8. The heat dissipation module of claim 7, wherein the heat pipe is U-shaped and the condenser section is parallel to the evaporator section.

9. The heat dissipation module of claim 7, wherein the heat sink defines a notch at a top portion for receiving the condenser section of the heat pipe.

10. The heat dissipation module of claim 1, wherein the heat sink comprises a plurality of fins stacked together, the fins being parallel to and spaced from each other.

11. The heat dissipation module of claim 1, wherein the fan comprises an impeller, a base, a sidewall extending upwardly from an outer periphery of the base, a cover engaged with the sidewall, the cover, the base and the sidewall cooperatively defining a cavity receiving the impeller therein.

12. The heat dissipation module of claim 11, wherein the air outlet is defined between two ends of the sidewall, the duct extending from the sidewall of the fan, the duct communicating with the cavity.

13. A heat dissipation module comprising:

a heat absorption board used for thermally connecting a heat generating component;

a fan comprising an impeller, the fan having a cavity receiving the impeller therein, and an air outlet at one side thereof and communicating with the cavity;

a hollow sealed duct extending from the fan along a direction away from the outlet of the fan, a first open end of the duct communicating with the cavity, and a second open end of the duct facing to the heat absorption board, the duct further comprising a bottom plate and two side plates extending from two opposite sides of the bottom plate, and the two side plates extending beyond an edge of the bottom plate;

a heat sink located at the air outlet of the fan; and a heat pipe thermally interconnecting heat absorption plate and the heat sink.

14. The heat dissipation module of claim 13, further comprising a fixing board connecting the fan via the duct, the heat absorption board thermally connecting a bottom surface of the fixing board, and the heat pipe thermally connecting a top surface of the fixing board.

15. The heat dissipation module of claim 14, wherein the fixing board defines an elongated channel at the top surface receiving a first end of the heat pipe, and a receiving hole at the bottom surface receiving the heat absorption plate.

16. The heat dissipation module of claim 15, wherein the receiving hole communicates with the elongated channel.

17. The heat dissipation module of claim 13, wherein the fan comprises a sidewall surrounding the cavity, the duct with the first open end extending into and through the sidewall to communicate with the cavity.

18. The heat dissipation module of claim 1, wherein the duct further comprises a top plate.

19. The heat dissipation module of claim 18, wherein the top plate extends beyond the edge of the bottom plate.

* * * * *